US007066298B1

(12) United States Patent
Mackinnon

(10) Patent No.: US 7,066,298 B1
(45) Date of Patent: Jun. 27, 2006

(54) STEP OR BRACKET DEVICE

(76) Inventor: Bruce Raymond Mackinnon, P.O. Box 25700, St. Heliers, Auckland (NZ)

( * ) Notice: Subject to any disclaimer, the term of this patent is extended or adjusted under 35 U.S.C. 154(b) by 0 days.

(21) Appl. No.: 09/926,441

(22) PCT Filed: May 5, 2000

(86) PCT No.: PCT/NZ00/00068

§ 371 (c)(1),
(2), (4) Date: Jan. 22, 2002

(87) PCT Pub. No.: WO00/68541

PCT Pub. Date: Nov. 16, 2000

(30) Foreign Application Priority Data

May 5, 1999 (NZ) ..... 335619

(51) Int. Cl.
*E06C 9/00* (2006.01)

(52) U.S. Cl. ..... 182/92

(58) Field of Classification Search ..... 182/92; 248/222.13
See application file for complete search history.

(56) References Cited

U.S. PATENT DOCUMENTS 759,868 A * 5/1904 Eich ..... 254/104
1,206,203 A * 11/1916 Brockway ..... 248/68.1
1,740,873 A 12/1929 Pierce, Jr.
1,952,111 A 3/1934 Bales ..... 211/136
2,257,962 A * 10/1941 Kemper ..... 411/354
3,399,746 A * 9/1968 Wood ..... 182/92
3,833,090 A * 9/1974 Georgianna ..... 182/92
4,140,414 A * 2/1979 Buttgereit ..... 403/71
4,534,529 A 8/1985 Dorner ..... 248/222
4,889,304 A * 12/1989 Glickman et al. ..... 248/222.13
5,941,485 A * 8/1999 Davidson et al. ..... 248/218.4
6,378,822 B1 * 4/2002 Franks ..... 248/218.4
6,491,272 B1 * 12/2002 Franks ..... 248/218.4

FOREIGN PATENT DOCUMENTS

DE 9405295 7/1994
DE 9405295.6 7/1994
EP 0519316 A1 12/1992

* cited by examiner

*Primary Examiner*—Alvin Chin-Shue

(74) *Attorney, Agent, or Firm*—Jacobson Holman PLLC
n

(57) ABSTRACT

A bracket device for attachment to a thin walled section includes a main member having an operating member, and an attachment hook extending from a proximal end of the operating member which in use engages with the thin walled section, and a locking wedge associated with the attachment hook which slides in relation to the attachment hook to a locking position to create a reaction force between the attachment hook and the thin walled section.

2 Claims, 5 Drawing Sheets

STEP OR BRACKET DEVICE

This is a nationalization of PCT/NZ00/00068 filed May 5, 2000 and published in English.

TECHNICAL FIELD

This invention relates to an easily installed removeable bracket device incorporating for example an operating member such as a step or a suspension bracket for attachment to a steel utility pole, a concrete utility pole incorporating a thin wall section for bracket attachment, or other thin wall section structures.

BACKGROUND ART

Conventional utility poles are manufactured using one of two alternative constructions. Historically they have been either hard or soft wood poles, but with modern manufacturing techniques thin wall steel poles are also becoming more common. The majority of such poles are employed in either telecommunications or electrical power transmission.

In order to fix faults or to assess the condition of attachments at the top of the pole, it is often necessary for servicemen to scale the pole and work near the top. In the case of a steel pole this can be accomplished in one of two ways: either by use of a ladder, or by use of steps integrated with the pole itself. The disadvantage to using ladders is that they can be unstable and sometimes not long enough. Therefore the risk of falling from the pole is higher. With wooden poles the use of ladders or the provision of steps is not necessary, because the servicemen are generally able to scale the pole using clamp-ons and a safety strap.

Increasingly suppliers are requesting that steel pole manufacturers supply their poles with steps already attached, in order to avoid the problems associated with ladders. From the manufacturers perspective this poses a difficulty, due to the additional cost associated with integrating steps with the pole. Typically this may add up to 20% or more to the production cost of a 40 foot distribution pole, thus putting the steel pole manufacturers at a distinct disadvantage to their wood pole counterparts.

The alternatives for attaching pole steps range from a nut welded to the side of the pole, to a complicated four piece arrangement, shown in FIG. 1, involving a shaped washer 1, a shaped bolt 2, a welded or riveted nut 3 and a pressed steel step 4. These arrangements are hardly ideal, they are often very unstable, and in some cases are quite unsafe to work on. Also as previously mentioned, a part, that is the nut 3 part, needs to be attached to each pole when manufactured, adding additional costs, and thereby reducing profit margins.

Moreover, there is also a need for bracket devices incorporating an operating member such as, a suspension bracket which is used for example for suspending fiber optic cables, or some other type of line hardware fitting, which can be easily installed and removed from steel utility poles, concrete utility poles incorporating a thin wall section for bracket attachment, or other thin wall section structures.

DISCLOSURE OF THE INVENTION

The object of this invention is to provide an easily installed removeable bracket device incorporating an operating member such as a step or suspension bracket that overcomes the abovementioned disadvantages.

In one aspect, the present invention may be broadly said to consist in a bracket device for attachment to a thin walled section which comprises: a main member having an operating member, and an attachment device extending from a proximal end of the operating member which in use engages with the thin walled section, and a locking device associated with the attachment device which slides in relation to the attachment device to a locking position to create a reaction force between the attachment device and the thin walled section.

The locking device may comprise any suitable device whereby a reaction force can be created between the attachment device and the thin walled section. For example this may comprise a cam device which is operated by a lever to actuate a cam to provided the reaction force.

Preferably the main member has a flange portion with the attachment device extending therefrom, and the locking device is a wedge member which is adapted in use to abut against a face of the flange portion.

Preferably the attachment device is terminated with a hook which in use engages within an aperture provided in a wall of the thin walled section.

Preferably an extremity of the hook is adapted to abut an inner wall of the thin walled section, and the wedge member is adapted when in the locking position to abut against an outer wall of the thin walled section to thereby create a compressive force between the hook and the wedge member to hold the operating member in place.

Preferably a slot is provided in the wedge member which in use substantially straddles the attachment device.

Preferably the slot is in the form of an enclosed slot.

Preferably an innermost face of the wedge member is substantially "V" shaped.

Alternatively an innermost face of the wedge member is substantially cylindrically concaved.

In a further alternative an innermost face of the wedge member is substantially flat.

Preferably the wedge member includes a channel adapted to encompass the flange portion of the main member.

More preferably the wedge member is substantially symmetrical with the channel formed concave matching the opposite side, and the abutting face of the flange portion of the main member is formed as a complementary convex face.

Alternatively the proximal end of the operating member includes a lower portion which in use locks into the slot to create a reaction force against any rotational torque on the operating member.

Preferably the operating member and the attachment device are constructed of forged steel.

Alternatively the operating member and the attachment device are constructed of forged aluminum.

Depending on requirements the operating member and the attachment device may be constructed of cast iron or steel or aluminum.

In a second aspect the present invention may be broadly said to consist in a method of providing a bracket device for a thin wall section comprising the steps:

a) forming an apparatus in the wall of the thin wall section at a position corresponding to a desired location of a bracket device, and b) forming a main member having an operating member and an attachment device extending from a proximal end of the operating member which in use engages within the aperture and which includes a locking device associated with the attachment device which slides in relation to the attachment device to a locking position to in use secure the attachment device within the aperture.

With the present invention as described above, the bracket device can be easily installed and removed from a thin wall section in which a suitable aperture has been formed. Moreover, the locking device ensures that this is stably secured in place.

The thin wall section may be part of any structure to which it is desired to removably attach a bracket device.

For example this may be part of a steel utility pole, or a thin wall section incorporated into a concrete utility pole. In this case the operating member may be in the form of a step for supporting a foot of a person wishing to climb the utility pole. Alternatively the operating member may be in the form of a suspension bracket for suspending hardware from the utility pole.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples.

BRIEF DESCRIPTION OF THE DRAWINGS

Further aspects of the present invention will become apparent from the ensuing description which is given by way of example only and with reference to the accompanying drawings in which.

BEST MODE FOR CARRYING OUT THE INVENTION

The invention is principally described in the preferred embodiments is a pole step for attachment to a steel utility pole which is able to be easily attached to and removed from the pole as and when required. The step is locked in place once attached, using a wedge member to ensure that it provides a secure and firm platform from which servicemen can work. The wedge member may be adapted to fit any shape of utility pole, and be repeatably attached and removed by servicemen each time they need to scale a pole.

Figure 1:
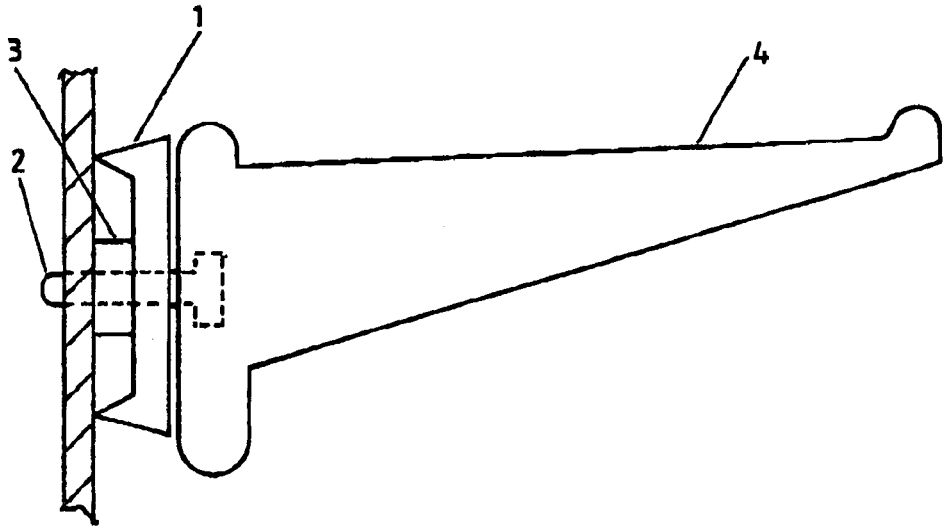
FIG. 1 (Prior Art)
FIG. 1 is an illustration of a prior art step.
Figure 2:
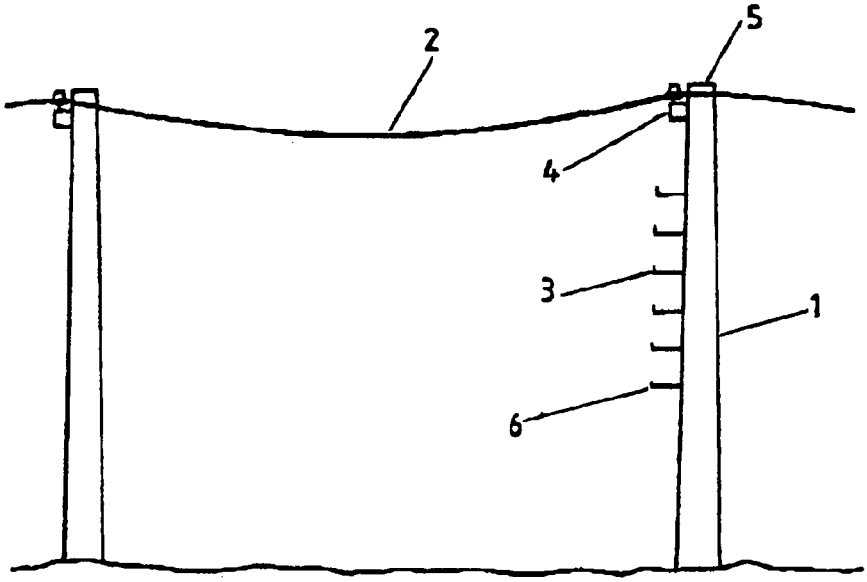
FIG. 2 is an illustration of a steel utility pole with pole steps attached.

A typical steel utility pole 1, shown in FIG. 2, is used by utilities to carry their wires 2. Steps 3 are spaced at even intervals to allow the servicemen (not shown) to scale the pole 1 to a point where the servicemen can work on attachments 4 at the top of the pole 5. Steps are not provided on the lower section of the pole so as to stop passers-by from being able to scale the pole 1. The servicemen will scale a first step 6 using a ladder (not shown) or some other climbing means.

Figure 3:
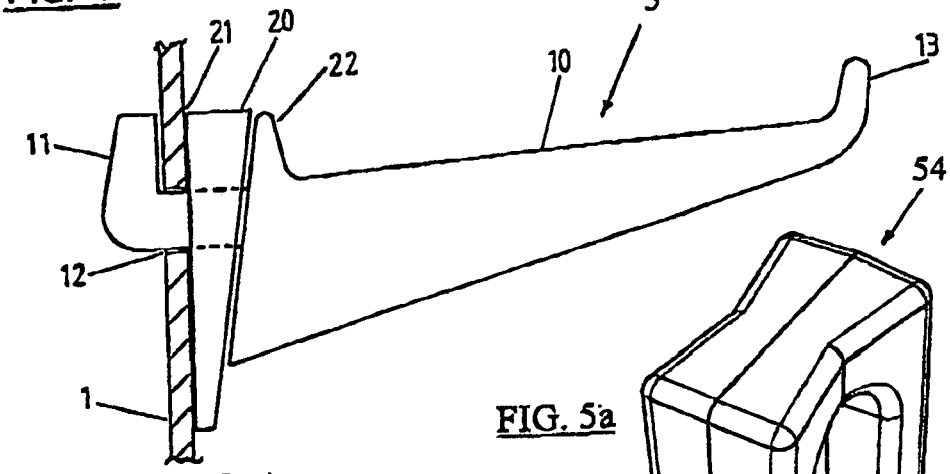
FIG. 3 is a cut-away view showing a pole step of FIG. 2 attached to the steel utility pole with a wedge member fitted in place.

The pole step 3, as shown in more detail in FIG. 3, is designed to be removably attached to the pole 1. The step 3 is comprised of a main member generally indicated by arrow 5 having a tapered support surface 10 (operating member) for the servicemen to stand on while climbing the pole 1 or while working on the attachment 4. Integral with the support surface 10 is a hook 11 (attachment device) which is leverably inserted into a hole 12 in the exterior of the pole 1 and which provides an opposing force to hold the step 3 in place. The support surface 10 is terminated at its distal end with a lip 13 to prevent the footwear of the serviceman from slipping off the edge of the support surface 10. The main member 5 including the support surface 10 and the integral hook 11 may be constructed either from cast aluminum, cast SG iron, forged steel or any other robust material.

A wedge member 20 is designed such that once the hook 11 has been inserted into the interior of the pole 1, the wedge member 20 can be inserted between the exterior 21 of the pole 1 and a flange portion 22 of the main member 5. Once inserted the wedge member 20 will lock the main member 5 in place providing firm vertical and horizontal support such that any servicemen will be assured a safe working platform.

Figure 4A:
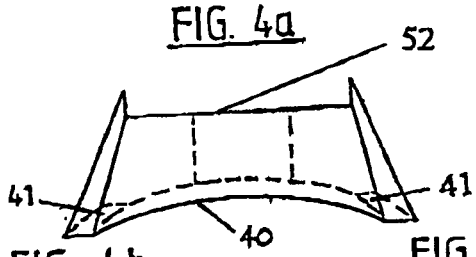
FIG. 4*a* is a plan view of the wedge member.
Figure 4B:
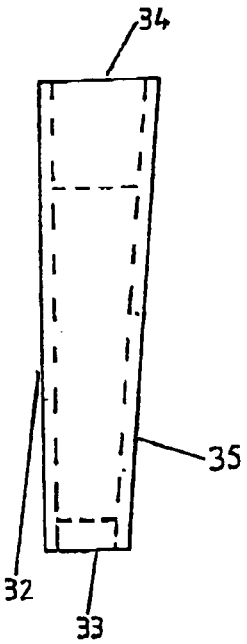
FIG. 4*b* is a side view of the wedge member.
Figure 4C:
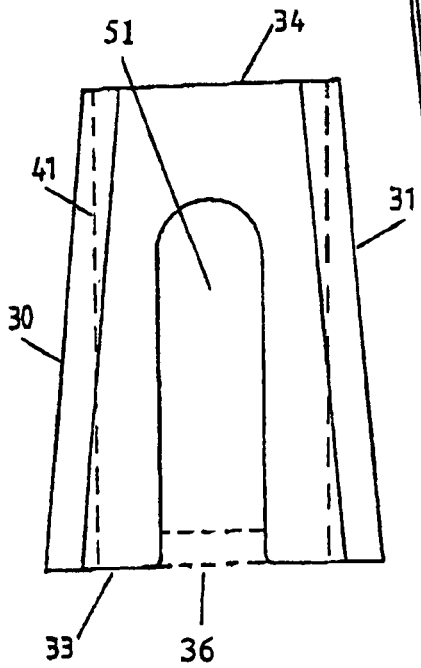
FIG. 4*c* is a frontal view of the wedge member viewed from the pole side.

The wedge member 20, shown in more detail in FIGS. 4*a*, 4*b* and 4*c* is tapered on two sides 30, 31 and on one face 32. Looking towards the pole, shown in FIG. 4*c*, the wedge member 20 sides 30 and 31 are tapered, being widest at a lowermost portion 33 and narrowest at an uppermost portion 34. This can be seen in more detail in FIG. 4*a*. Looking now from the side shown in FIG. 4*b* (parallel to the side of the face of the pole 1), the outermost faces 32 and 35 of the wedge member 20 are tapered, being widest at the uppermost portion 34 and narrowest at the lowermost portion 33.

Preferably the taper angle between the outermost faces 32 and 35 of the wedge member 20 is such as to give a wedge angle of from 3.5 to 5 degrees. This is to ensure self locking of the wedge member 20 when, after the hook 11 is inserted into the hole 12, the wedge member 20 is dropped and firmly seated in place from above. Moreover, the contact faces 32 and 35 of the wedge member 20 and/or the contact face of the flange portion 22 may be formed with a roughened or serrated surface to enhance securement.

Furthermore, as shown by the dotted lines in FIG. 4*c*, at the lowermost portion 33, a bridge portion 36 may be formed either integrally or attached, thus closing off a slot 51 (described later) to give an enclosed slot. Having such a bridge portion 36 has the advantage that the main member 4 and the wedge member 20 combination can be installed using only one hand. In this case, the hook 11 is first inserted through the central opening (slot 51) of the wedge member 20 to suspend the wedge member 20, and is then inserted into the hole 12. The wedge member 20 can then be swung upwards through 180 degrees into position and dropped into place, and then tapped in tightly.

Looking now from above, seen in FIG. 4*a*, the innermost face 40 of the wedge member 20 is substantially cylindrically concaved, with small flat sections 41 (shown dotted in FIGS. 4*a* and 4*c*) on either side. The cylindrically concaved innermost face 40 is designed to adapt to circular poles, with the flat sections 41 provided for where the wedge member 20 faces a flat surface, for example larger poles with hexagonal or dodecanol faces. The innermost face 40 is tapered to match the typical shape of a conventional steel utility pole. For more reliable securement on larger poles with wide faces, an alternative wedge member, as shown in FIG. 5, can be used with a completely flat innermost face 50.

To accommodate the shaft of the hook 11, the slot 51 is provided in the body of the wedge member 20. A channel 52 (also shown in dotted outline in FIG. 4*c*) is formed in the outermost face of the wedge member 20 to accommodate the flange portion 22 of the step 10, to ensure once in place, the step 10 cannot rotate out of its correct position. It should be noted that details of the edge of this channel 52 are omitted from FIG. 3, which effectively shows a section view.

The channel 52 may be formed as shown in FIG. 4*a* in a rectangular shape in cross-section in the case where the flange portion 22 of the step 10 is of a matching shape.

Figure 5A:
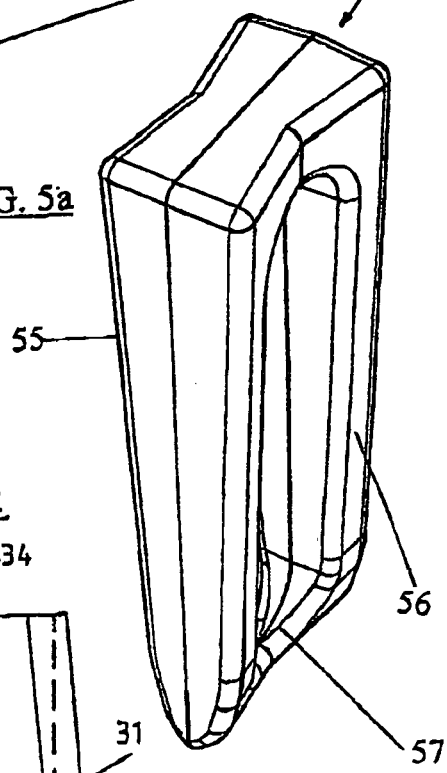
FIG. 5*a* is a perspective view of another alternative wedge member.
Figure 5:
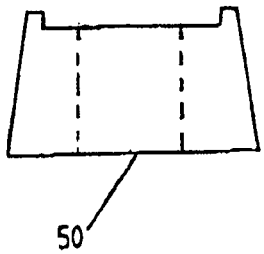
FIG. 5 is a plan view of an alternative wedge member.

FIG. 5*a* shows an alternative wedge member generally indicated by arrow 54. Here the wedge member 54 comprises an outer face 55 (channel) formed as a concave shape (here a concave "V" shape) the same or approximately the same shape as an inner face 56, and having an enclosed slot with a bridge portion 57. In this case the face of the flange portion 22 of the main member 5, while not shown specifically, is formed as a matching convex surface (a convex "V" shape). With such an arrangement the wedge member 54 can be made symmetrical with the inner face 56 still adequately matching the typical shape of a conventional steel utility pole. Moreover, the engagement of the matching faces of the convex surface of the flange portion 22 and the concave surface of the outer face 55 ensures that once in place, the step 10 cannot rotate out of its correct position.

The wedge member 20 may be manufactured using SG iron, forged steel, injection molded plastic, aluminum or alternatively using rubber, or any other suitably robust material.

Figure 6A:
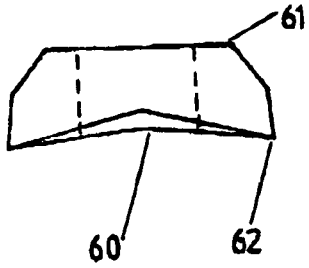
FIG. 6*a* is a plan view of the wedge member in a second embodiment.
Figure 6B:
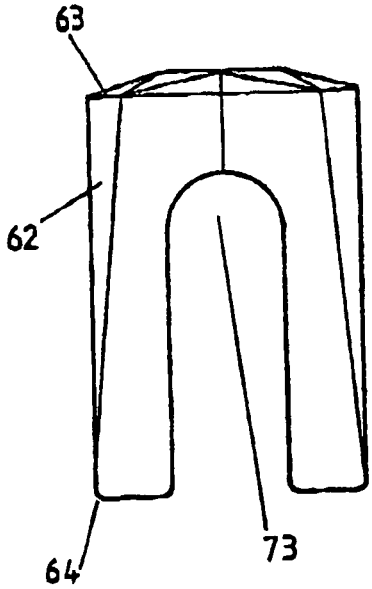
FIG. 6*b* is a frontal view of the wedge member in the second embodiment.

In a second embodiment, an alternative wedge member 61 is shown in FIG. 6*a* without tapering sides, and can be constructed using slightly less material than that described in the preceding embodiment for the wedge member 20. Looking now from above, an innermost face 60 of the wedge member 61 is substantially "V" shaped and substantially rectangular in outline. Looking from the pole side, shown in FIG. 6*b* the "V" is tapered to substantially match the typical shape of a conventional steel utility pole. The flat sections 62 are widest at the uppermost portion 63 and taper to nothing at the lowermost portion 64.

Figure 7:
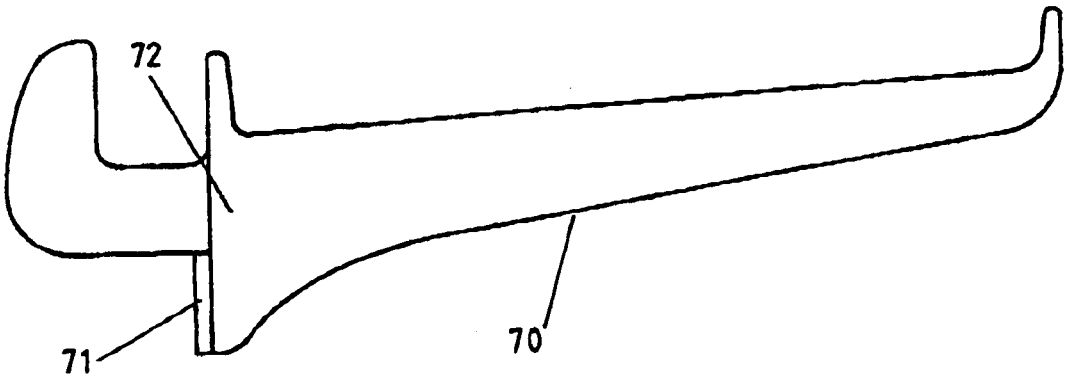
FIG. 7 is a side view of a step of the second embodiment.

In the second embodiment, the step 70 shown in FIG. 7 is provided with a key portion 71 protruding from a flange portion 72 which is designed to fit into a slot 73 of the wedge member 61. Once locked in place, this prevents the step 70 from rotating, thus ensuring that the step 70 stays locked in place.

Figure 8:
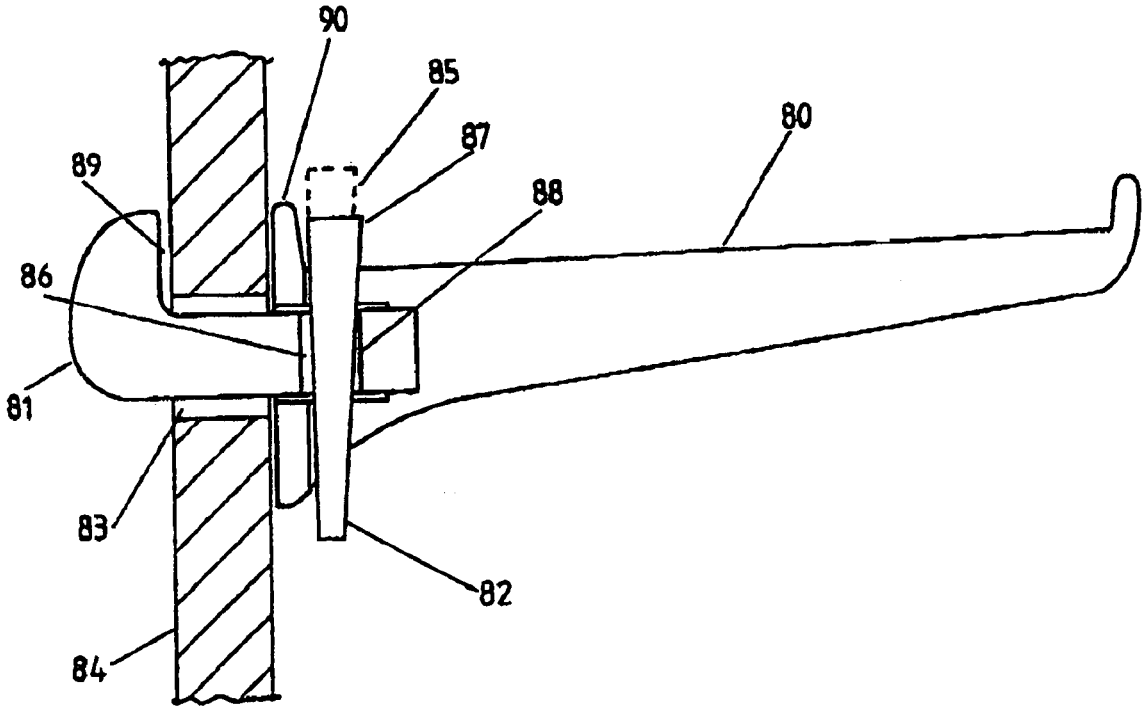
FIG. 8 is a side view of a step of a third embodiment.

In a third embodiment shown in FIG. 8, a step 80, a hook 81 and a wedge member 82 are all movable relative to one another. With this embodiment the hook 81 is leverably inserted into a hole 83 in a steel utility pole 84, with the wedge member 82 in an upper position 85. The hook 81 has grooves 86 in both sides which the wedge member 82 engages with. With the hook 81 inserted into a hole 83 in the exterior of a pole 84, the wedge member 82 is brought to a lower locked position 87. The movement of the wedge member 82 causes the distal side 88 of the groove to experience a lateral force, effecting a compressive force on the wall of the pole 84 between an end of the hook 89 and a flange portion 90 of the step 80.

It will be apparent from the description that a step design such as that described will be equally applicable to any application which requires an object to be suspended from a thin wall hollow structure. Examples include the suspension of fiber optic cables and many other line hardware fittings.

Figure 9:
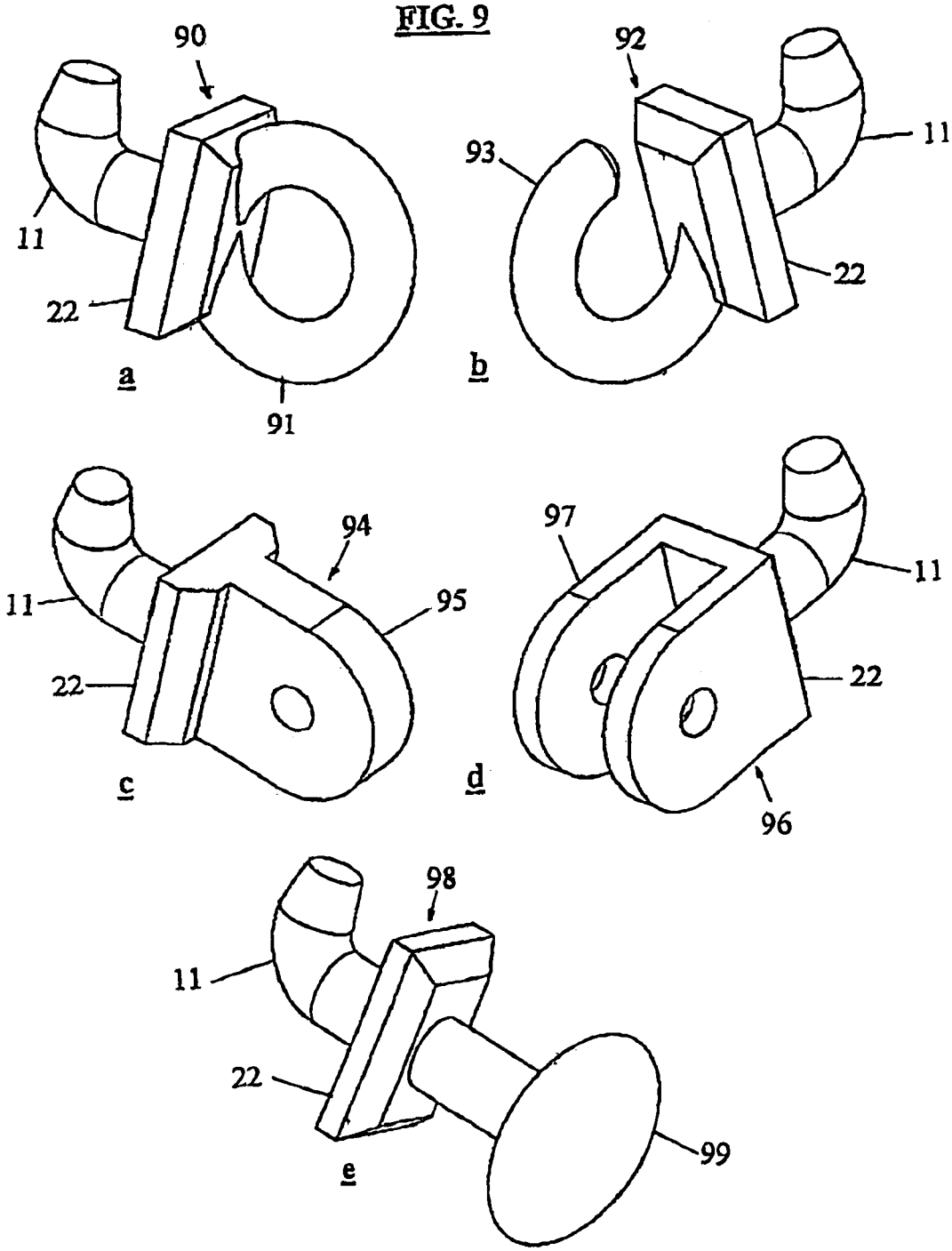
FIG. 9 is perspective views showing attachment devices according to the present invention having various operating members.

FIG. 9 is perspective views showing various main members of attachment devices according to the present invention having various operating members. In these figures, parts having the same function as described for the previous attachment device are denoted by the same reference numerals and detailed description thereof is omitted.

FIG. 9*a* shows a main member 90 having a ring operating member 91.

FIG. 9*b* shows main member having 92 having a hook operating member 93.

FIG. 9*c* shows main member 94 having a tongue operating member 95.

FIG. 9*d* shows main member 96 having a clevis operating member 97.

FIG. 9*e* shows main member 98 having a ball eye operating member 99.

Aspects of the present invention have been described by way of example only and it should be appreciated that modifications and additions may be made thereto without departing from the scope of the invention as defined by the appended claims.

INDUSTRIAL APPLICABILITY

The bracket device of the present invention provides an easily installed removable bracket device incorporating an operating member such as a step or suspension bracket, which overcomes problems with conventional methods and devices for attaching a bracket to a thin walled section. The bracket device thus offers may possible industrial applications.

What is claimed is:

1. A step for attachment to a utility pole having a thin wall section, the step comprising:

a main member having a step member with a flange portion formed at a proximal end thereof, a free end at a distal end thereof, and an upwardly facing support surface for a user to stand on, between said free end and said flange portion, and a single attachment portion integral with said step member extending from a face of said flange portion and terminated in a hook extending out from the flange, in alignment with said step member, then up, which in use extends through an aperture provided in a wall of said thin walled section, and a wedge member which is adapted to slide in a transverse relation to said attachment portion and interpose between said flange and said thin walled section, and abut against a face of said flange portion when in a locking position, to be driven downward to create a compressive force between said hook and said wedge member with said thin walled section therebetween to hold said step member in place, said wedge member comprising a body formed with an enclosed slot, and having an inner face and an outer face inclined relative to each other at an angle of from 3.5 to 5 degrees, said inner face and said outer face each being formed with a concave channel of substantially the same shape in cross section along a full length thereof.

2. In combination, a utility pole having a thin walled hollow section with a plurality of circular apertures through said thin walled hollow section for mounting steps to said pole, and at least one step comprising:

a step for attachment to a utility pole having a thin walled section, the step comprising:

a main member having a step member with a flange portion formed at a proximal end thereof, a free end at a distal end thereof, and an upwardly facing support surface for a user to stand on, between said free end and said flange, and a single attachment portion integral with said step member extending from a face of said flange portion and terminated in a hook extending out from the flange, in alignment with said step member, then up, and which extends through an aperture provided in a wall of said thin walled section and up behind said wall, and a wedge member which is adapted to slide in a transverse relation to said attachment portion, interposed between said flange and said thin walled section, and abutting against a face of said flange portion creating a compressive force between said hook and said wedge member with said thin walled section therebetween to hold said step member in place, said wedge member comprising a main body formed with an enclosed slot, and having an inner face and an outer face inclined relative to each other at an angle of from 3.5 to 5 degrees, said inner face and said outer face each being formed with a concave channel of substantially the same shape in cross section along a full length thereof, said hook passing through said enclosed slot.

* * * * *